US009181072B2

(12) United States Patent
Agarwal et al.

(10) Patent No.: US 9,181,072 B2
(45) Date of Patent: Nov. 10, 2015

(54) FOIL CUTTING CORK EXTRACTOR

(75) Inventors: Dhruv Agarwal, Seattle, WA (US); Erin Malaspino, Seattle, WA (US)

(73) Assignee: True Fabrications, Inc., Seattle, WA (US)

( * ) Notice: Subject to any disclaimer, the term of this patent is extended or adjusted under 35 U.S.C. 154(b) by 365 days.

(21) Appl. No.: 13/332,079

(22) Filed: Dec. 20, 2011

(65) Prior Publication Data

US 2012/0152081 A1 Jun. 21, 2012

Related U.S. Application Data

(60) Provisional application No. 61/425,120, filed on Dec. 20, 2010.

(51) Int. Cl.
*B67B 7/44* (2006.01)
*B67B 7/04* (2006.01)

(52) U.S. Cl.
CPC ..... *B67B 7/0441* (2013.01); *B67B 2007/0458* (2013.01); *Y10T 83/0341* (2015.04)

(58) Field of Classification Search
CPC ..... B67B 7/04; B67B 7/0441; B67B 7/44; B67B 7/0417; B67B 7/0423; B67B 7/0435; B67B 7/0447; B67B 7/12; B67B 7/02; B67B 7/06; B67B 2007/0458; Y10T 83/0341
USPC ..... 81/3.09, 3.36, 3.37, 3.29, 3.45, 3.56, 81/3.48, 3.49
See application file for complete search history.

(56) References Cited

U.S. PATENT DOCUMENTS

| | | | |
|---|---|---|---|
| 532,575 | A | 1/1895 | Morgan |
| 644,088 | A | 2/1900 | Morgan |
| 678,773 | A | 7/1901 | Coomber |
| 776,152 | A | 11/1904 | Strohacker |
| 4,253,351 | A | 3/1981 | Allen |
| 4,845,844 | A | 7/1989 | Allen |
| 5,653,023 | A | 8/1997 | Andina |

*Primary Examiner* — Hadi Shakeri
(74) *Attorney, Agent, or Firm* — Lowe Graham Jones PLLC

(57) ABSTRACT

A corkscrew includes a rotatable pinion gear having a fixed radius and a horizontal rotational axis rotatably coupled to a shaft and engaging a gear rack of a vertically translating driver. A helical worm is coupled through a freely rotating connection to the vertically translating driver wherein the corkscrew freely rotates about a longitudinal rotation axis coaxially aligned with a location of a bottle neck from which a corkscrew is to be withdrawn. A crank rotates the pinion gear for translating the driver up and down relative to the shaft along the rotation axis of the corkscrew. A helical pinion gear a helical pinion rack drives rotates about the longitudinal rotation axis in meshing engagement with helical rack on the vertically translating driver, the helical pinion gear having at least one blade to contact the bottle neck scoring a foil capsule thereon as the helical pinion gear rotates.

18 Claims, 4 Drawing Sheets

FOIL CUTTING CORK EXTRACTOR

PRIORITY CLAIM

The applicant claims priority to U.S. Provisional Patent Application 61/425,120 filed on Dec. 20, 2010 incorporated herein fully by this reference.

FIELD OF THE INVENTION

The applicant discloses a handheld tool for removing a cork from a beverage bottle, more specifically for removing the cork while cutting the foil capsule on a wine bottle.

BACKGROUND OF THE INVENTION

Various types of devices are used for extracting corks from bottles of wine. Of these, the best known is probably the simple corkscrew having an integral handle and a helical metal worm to rotate into the cork. A relatively high degree of skill and expertise is required to keep the simple corkscrew properly aligned and centered as it is being driven into a cork. Where the rotation of the corkscrew is significantly divergent from the central axis of the cork, the worm bears against the neck of the bottle causing the worm to grind rather than pierce the cork. A broken cork can stymie the efforts to pour the wine within the bottle making the simple corkscrew an impediment to rather than an implement for gaining access to the wine within the bottle.

More elaborate types of apparatus include a pair of handheld clamps that engage the neck of a bottle and insure alignment with the cork's central axis. With such alignment, the worm can be driven through the center of the cork such that its helix surrounds the axis and both engages and loosens the cork within the neck of the bottle. A patent that teaches the sued of the control nut is that Herbert Allen obtained U.S. Pat. No. 4,253,351 for a CORK EXTRACTOR. In addition to the handheld clamp, the Allen patent uses a control nut having a screw passage positioned to receive the worm and to guide the worm into the cork, as the worm moves along the cork's axis. The control nut imparts torque to the helical worm upon translation of the worm up and down in a frame in response to rotation of a crank lever. The Allen solution assures a far greater likelihood of successful extraction when compared to a manually turned T-handle to screw the worm into the cork.

Other cork screw patents have been issued having a similar cork extracting apparatus such as U.S. Pat. Nos. 678,773, 644,088, 776,152 and 532,575. The worm is rotatably mounted in a driver, which reciprocates along a frame. As the driver and worm are moved downwardly by a suitable actuator such as a crank handle, the worm is driven by a lateral motion through a mating screw passage in a control nut. During this movement, the control nut is restrained against both longitudinal and rotational movements relative to the frame. The worm is allowed to rotate as the driver moves the worm into the control nut. Thus is the worm driven into the cork in a bottle as the bottle is fixed in position below the control nut. Subsequently, the driver and worm are refracted upwardly by further movement of the actuator. At this time the control nut is still restrained against rotational movement with respect to the frame but is permitted to move longitudinally with the driver and worm. Thus, the corkscrew may be drawn upwardly without rotation to extract the engaged cork from the bottle.

Most such devices further provide for stripping the extracted cork from the screw. In particular, the actuator is used to again lower the carrier, corkscrew, and control nut, and when the latter reaches its original position, it is once again restrained against longitudinal movement with respect to the frame. Then, as the carrier is raised a second time, the corkscrew moving therewith will be rotated in a reverse direction by virtue of its passage through the screw passage of the fixed control nut, and will thereby be removed from the cork.

Bottled wines, however, are usually sealed with a foil which covers the head portion of a bottle wine. Thus, before a cork can be extracted from a bottle and the wine within can be poured, the sealing foil must be removed. Removal of the foil is a separate motion with a distinct set of tools. Foil cutters for removing foil from the neck of a wine bottle, however, are well known and are a common household item.

For example, U.S. Pat. No. 4,845,844 describes a separate foil cutter with a plurality of cutting wheels distributed around the perimeter of a circle. The foil cutter includes a bifurcated hand piece in which two cutting wheels are disposed on corresponding opposite sides on the bifurcated arms. The bifurcated arms are resiliently movable towards each other so that the plurality of cutting wheels can move into cutting engagement with the sealing foils.

Likewise, U.S. Pat. No. 5,653,023 describes a foil cutter with a U-shaped body and a sharp metal cutting blade that is substantially curved in a semi-circular shaped disposed on each side of the U-shaped body. Each of these foil cutters is a distinct implement from any cork extractor and must be applied to remove foil before the cork extractor can remove the cork from the bottle.

What is missing from the art is a foil cutting cork extractor configured to remove the foil and cork in a single motion.

SUMMARY OF THE INVENTION

A corkscrew includes a rotatable pinion gear having a fixed radius and a horizontal rotational axis rotatably coupled to shaft and engaging a gear rack of a vertically translating driver. A helical worm is coupled through a freely rotating connection to the vertically translating driver wherein the corkscrew freely rotates about a longitudinal rotation axis coaxially aligned with a location of a bottle neck from which a corkscrew is to be withdrawn. A crank rotates the pinion gear for translating the driver up and down relative to the collar along the rotation axis of the corkscrew. A helical pinion gear a helical pinion rack drives rotates about the longitudinal rotation axis in meshing engagement with helical rack on the vertically translating driver, the helical pinion gear having at least one blade to contact the bottle neck scoring a foil capsule thereon as the helical pinion gear rotates.

As the helical pinion gear rotates, the blade or blades radiate inward. In one preferred embodiment, springs urge the blades into contact with the neck of the bottle scoring and cutting the foil as the worm extracts the cork from the bottle neck. In one movement, then, the cork is extracted from the bottle pressing the cork into the severed foil capsule fragment lifting it from the bottle.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

A lever corkscrew is configured to twist a worm into a cork, circumferentially cut a section of foil, and extract the cork from the bottle with one complete push and pull motion of the top lever. A corked bottle is positioned and held into place with two side handles. A top lever rotates a spur pinion gear. This spur pinion gear drives a rack laterally that augers an attached worm into a cork. In a preferred non-limiting embodiment, the rack is a component of a driver which includes a tube oriented laterally along lateral direction of travel that houses a spare worm and itself forms a helical rack having cogs along its length. As the cogs on the tube travel lateral they strike teeth on a helical pinion gear causing it to spin in a plane perpendicular to the lateral travel. Blades on the helical pinion gear extend radially inward to cut foil when the lever is pushed or pulled. The lever is then lifted up to an open position which in turn removes the cork and cut foil cap from the bottle. Repeating the motion removes the cork and foil cap from the worm.

Figure 1:
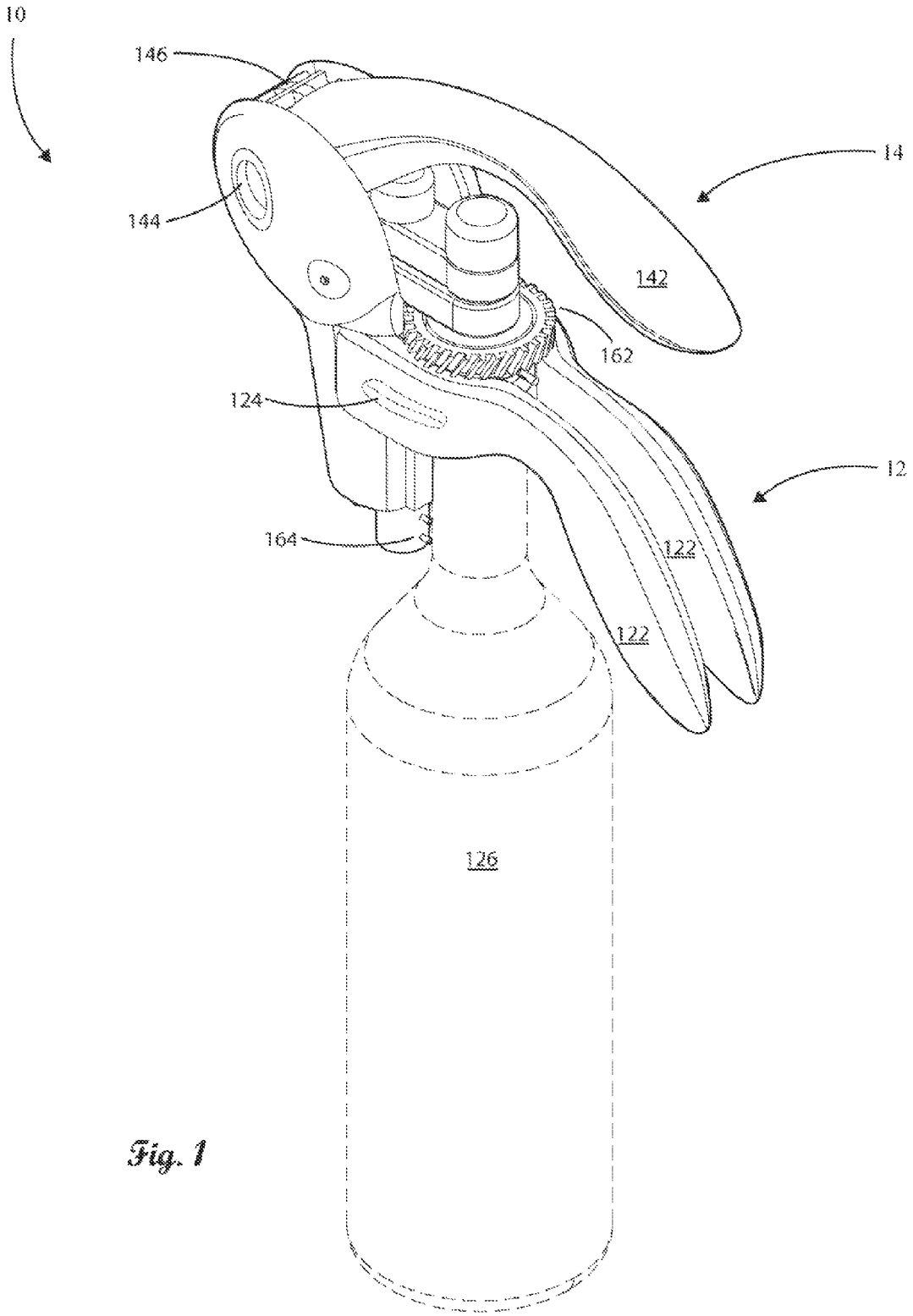
FIG. 1 depicts an inventive cork extractor having a helical pinion gear bearing at least one blade to score a foil capsule on the bottle.
Figure 3:
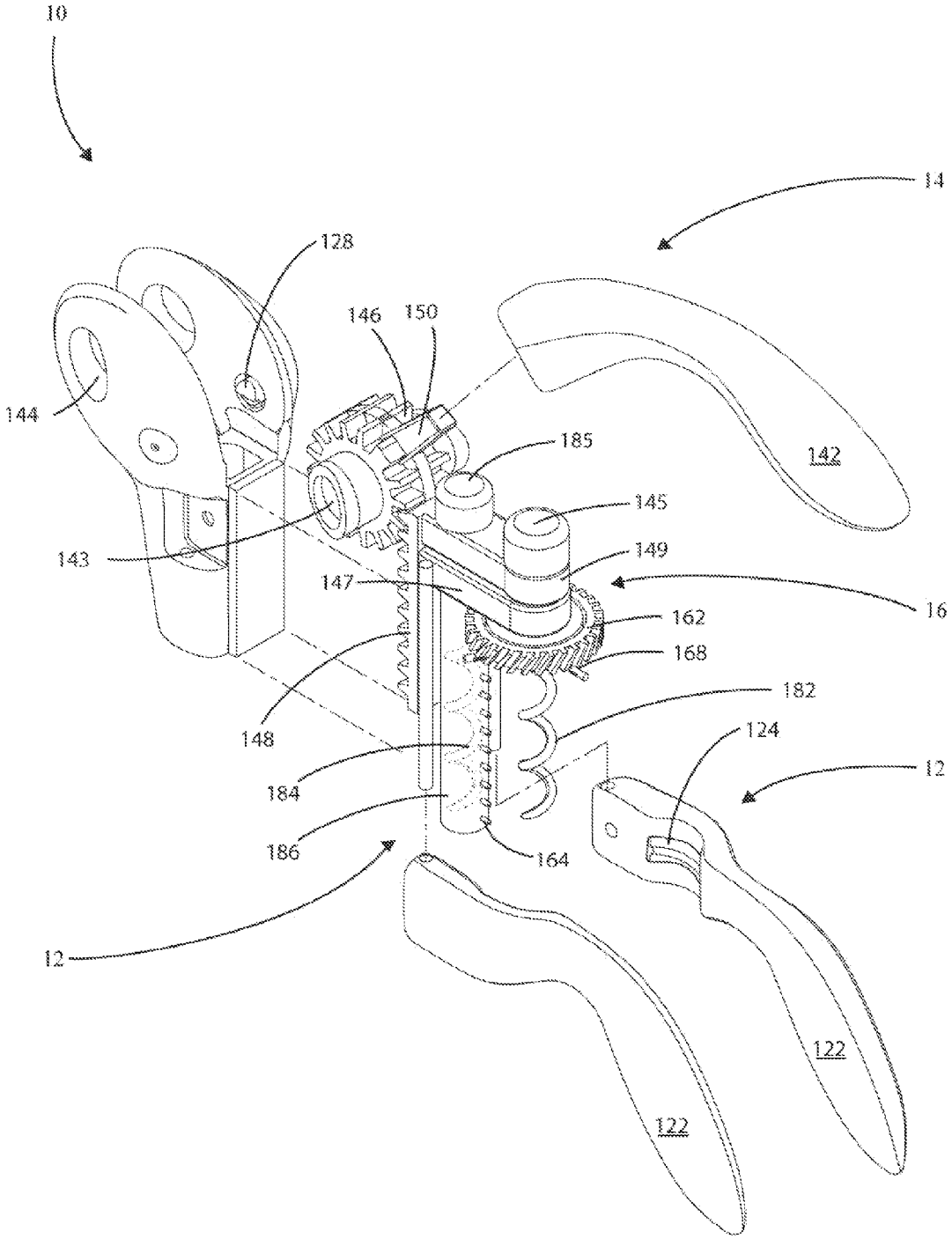
FIG. 3 is an exploded view of the inventive cork extractor, depicting the helical pinion gear, a worm and clamps.
Figure 4:
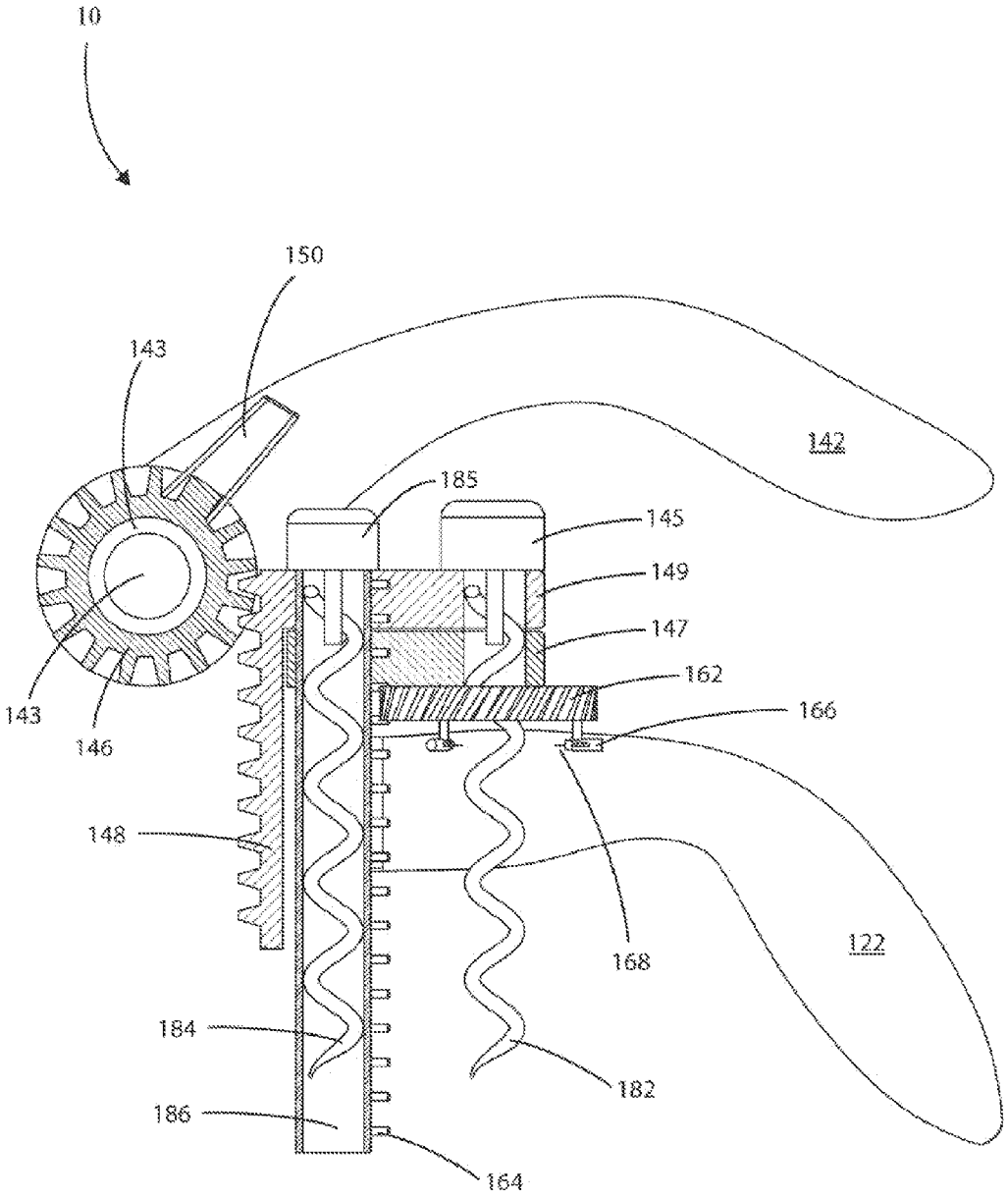
FIG. 4 is a cross-sectional view of the inventive cork extractor depicting the helical pinion gear relative to the worm and the clamps.

Referring to FIGS. 1, 3, and 4, a cork extracting machine 10 includes a rotatable pinion gear 146 having a fixed radius and a horizontal rotational axis 144 rotatably coupled to shaft 143 and engaging a gear rack 148 of a vertically translating driver assembly 16. The rotatable pinion gear 146 is driven by a crank handle 142 the user rotates. In turn, the pinion gear 146 engages a pinion rack 148 affixed to a driver assembly 16 which oscillates axially in response to movement of the driver assembly 16. Converting a rotation movement which is very human-natural into pure axial oscillatory movement assures that attempt to remove the cork does not degrade or split the cork. The movement of the driver assembly 16 in response to movement of the crank handle 142 facilitates both the removal of the cork and the cutting of the foil capsule that encloses the cork.

In a presently preferred embodiment, the vertically translating carrier assembly 16 comprises opposed first and second radially outward facing surfaces, the first radially outward facing surface includes the gear rack and the second radially outward facing surface including the helical rack. In the presently preferred embodiment, the carrier assembly 16 includes, as well, a spare worm pivot 185, a spare worm 186, and a tubular housing to carry both in a worm driving stanchion 149. While none of these contribute to the operation of the cork extraction or foil cutting mechanism, they are optionally added to increase the appeal of the device by To securely control the extraction of the cork, a helical worm 182 is coupled through a freely rotating connection or worm pivot 145 to the vertically translating driver assembly 16 wherein the worm 182 freely rotates about a longitudinal rotation axis coaxially aligned with a location of a bottle neck from which the cork is to be extracted. As the vertical driver assembly 16 oscillates, that oscillatory motion pulls the cork from the bottle. The free rotation the worm pivot allows 145, movement of the worm 182 into a non-rotating collar cam 147. The non-rotating collar cam 147 guides the worm 182 as a follower receiving and following the helical worm 182 for imparting torque and, thus, rotating the worm 182 in response to the lateral movement of the driver assembly 16.

The non-rotating collar cam 147 is releasably coupled between the axially translating driver 16 and an annular collar assembly 12, to alternate between piercing the cork and stripping the cork in the same movement. In the presently preferred embodiment, the release of the rotating collar cam 147, strips the cork and the foil from the worm 182.

Optimal cork extraction relies upon the introduction of the worm 182 into the cork to along a center axis of the cork such that the worm 182 will travel helically and generally axially into the cork thereby avoiding any off-axis play in the movement of the worm 182 which would degrade the structure of the cork causing separation within the matrix of the cork along the path of the worm 182. To assure alignment of the bottle and, thus, the cork with the worm 182, the annular collar assembly 12 includes a pair of resilient clamp members 124 having respective opposable clasp portions 122 relatively movable toward each other. The resilient clamp members 124 clasp the neck of a bottle and position the bottle with respect to the collar 16 in longitudinal alignment with the screw passage, and away from each other, to release the bottle.

The clamp members 124 include respective attachment portions meet in clamshell fashion such that the rigidly adjoining respective ones of the clasp portions and having pivot means mounted on the collar generally to one side of the longitudinal rotation axis clasped by the clasp portions to permit the relative movement of the clasp portions toward and away from each other. The respective grip portions 122 each rigidly extends from a respective one of the clasp portions generally on the opposite side of the clasp portion from the respective attachment portion, the grip portions being movable toward and away from each other for so moving the clasp portions. The presently preferred embodiment, wherein the clasp portions have opposed padded arcuate bottle-engaging surfaces 124, allows hand pressure on the handle 122 to be applied to firmly grasp the bottle. In such embodiments, the bottle-engaging surfaces 124 of the clasp portions have downwardly and inwardly inclined support sections for underlying the drip ring of a bottle.

Figure 2:
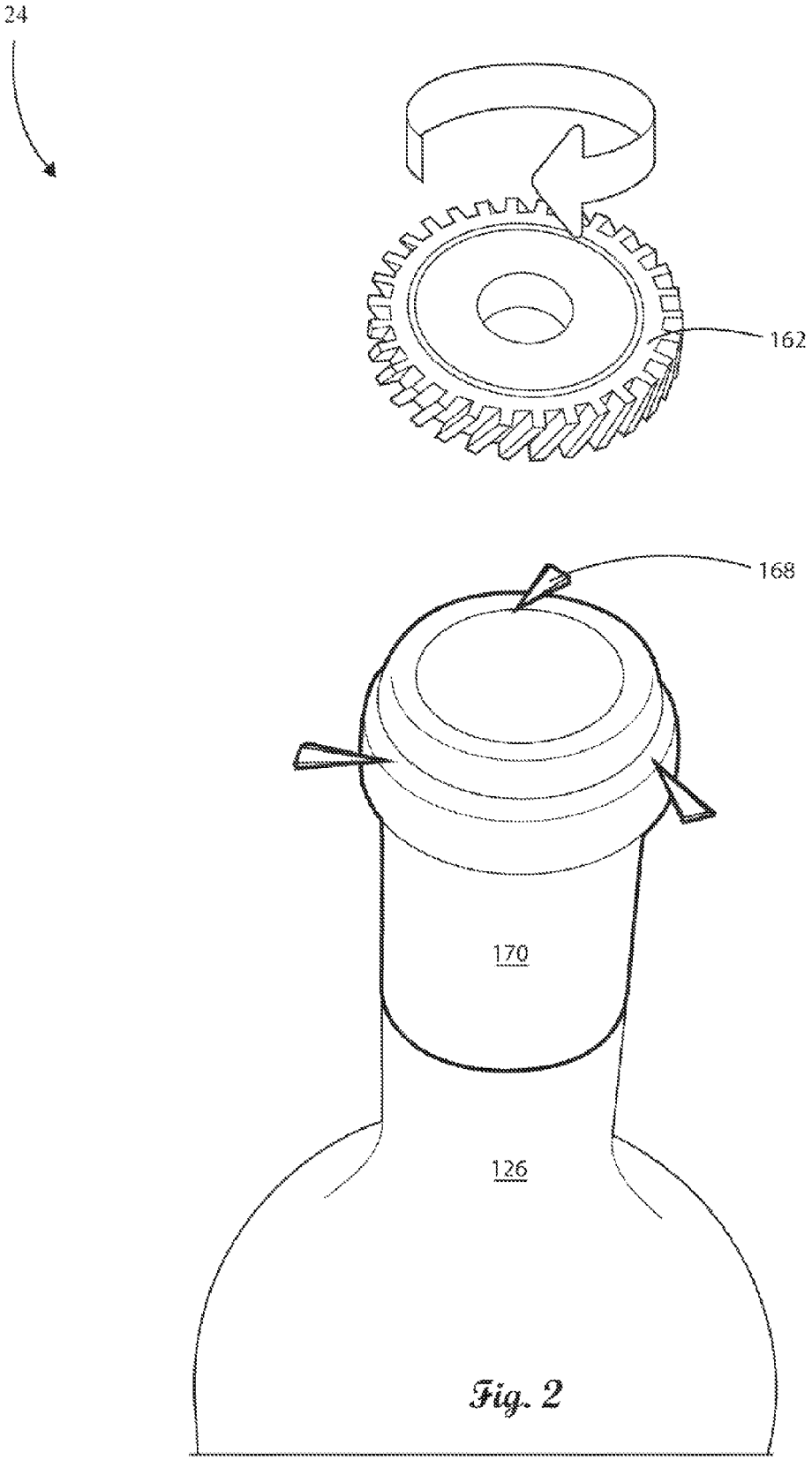
FIG. 2 depicts rotational movement of the blades in urged contact with the bottle to score the foil capsule.

Having discussed the movement of the worm 182 for extraction, we turn to the foil cutting facility of the cork extraction device. Referring to FIG. 2, the principal movement of blades 168 that score and cut a foil capsule on the bottle to liberate the cork the capsule encloses is a circular movement. Springs 166 urge blades radially inward in a non-limiting embodiment. With resilient springs 166, the neck of a bottle is readily admitted, allowing the blades 168 to score the capsule and having scored the capsule, after extraction, to remove the neck of the bottle from the cork extractor without additional distinct movement.

Referring again to FIGS. 1, 3, and 4, a helical rack 184 drives the helical pinion gear 162 to rotate about the longitudinal rotation axis in meshing engagement with helical rack 148. The above-described oscillatory motion of the vertically translating driver 16, converts in the interplay between the helical rack 148 and the helical pinion gear 146. The helical nature of the gears offers a refinement over spur gears. The leading edges of the teeth are not parallel to the axis of rotation, but are set at an angle. Since the gear is curved, this angling causes the tooth shape to be a segment of a helix. While helical gears can be meshed in a parallel or crossed orientations, the utility of the instant configuration is in that the helical rack 184 is oriented at a right angle to the helical pinion gear 162.

In normal power transmission, employing a helical pinion gear 162 in right angle orientation, the helical pinion gear 162 contacts the helical rack 184 only in a point, and not a line. Thus, it has been seen that very little power can actually be transmitted in such a configuration. Scoring the foil does not so much require power but rather simply drawing a blade 168 across the foil of a capsule. For this reason, in the presently preferred embodiment, the helical rack 184 can be formed of pins rather than full length helical teeth as these pins depicted in FIGS. 3 and 4. Exploiting the helical rack's 184 oscillatory movement by conversion into rotary movement at the helical pinion gear 162, drives the at least one blade while in contact with the bottle neck in a circumferential path, scoring a foil capsule thereon as the helical pinion gear 162 rotates.

To make the blades more effective in producing a uniform score in the foil capsule, the blades 168, are urged inward radially by blade springs 166 allowing the blades to continually shift position as the blades make their orbital path about the drip ring on the neck of the bottle, applying constant pressure against the foil to optimally separate the capsule in a linear cut.

When extended by the springs 166, the blades 168 contact the foil surface of the capsule and as the blades 168 are fixed to a helical pinion gear 162, their cutting edges literally circumscribe the bottle neck at a drip ring to score and cut the capsule. The rotational movement of the helical pinion gear 162 motivates the blades 168 in the circular paths to allow cutting of the foil at the drip ring. While shown as triangular blades each with an apex contacting the foil, other arrangements of blades 168 are suitable within the teaching of this disclosure. For example, wheels with sharpened circumferential edges also serve to suitably score and cut the foil and can be readily substituted for the triangular blades depicted herein with departing from the invention.

As is readily observed, then, the rotation of the crank handle 142 and with it the pinion gear 146 causes the translational movement of the vertically translating driver assembly 16. Simultaneously, movement of the vertically translating driver assembly 16 drives the worm 182 into the cork as it also moves the blades 168 in circumferential orbit of the bottle neck, scoring and ultimately cutting the foil. When the rotation of the crank handle 142 is reversed, the cork is extracted from the bottle neck, taking with it the severed foil fragment the blades 168 have cut from the bottle neck. Cycling through a second rotation and reversing of the crank handle 142 strips the cork and the foil from the worm 182 readying the worm 182 for another cork extraction.

While the preferred embodiment of the invention has been illustrated and described, as noted above, many changes can be made without departing from the spirit and scope of the invention. For example, a stanchion might fix the collar assembly 12 to a bar top to allow a fixed rather than handheld embodiment. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A cork extracting machine comprising in combination, a rotatable pinion gear having a fixed radius and a horizontal rotational axis rotatably coupled to a shaft and engaging a gear rack of a vertically translating driver;

a helical worm coupled through a freely rotating connection to the vertically translating driver wherein the worm freely rotates about a longitudinal rotation axis coaxially aligned with a location of a bottle neck from which the cork is to be extracted;

a crank rotating the pinion gear for translating the driver up and down relative to the shaft along the rotation axis of the helical worm;

a non-rotating cam releasably coupled between the vertically translating driver and an annular collar assembly receiving and following the helical worm for imparting torque rotating the worm; and a helical pinion rack affixed to the gear rack drives a helical pinion gear to rotate about the longitudinal rotation axis in meshing engagement with helical pinion rack on the vertically translating driver, the helical pinion gear having at least one blade to contact the bottle neck scoring a foil capsule thereon as the helical pinion gear rotates.

2. The machine of claim 1 wherein the annular collar assembly includes a pair of clamp members having:

respective opposable clasp portions relatively movable toward each other, to clasp the neck of a bottle and position the bottle with respect to the collar in longitudinal alignment with a screw passage, and away from each other, to release the bottle;

respective attachment portions rigidly adjoining respective ones of the clasp portions and having pivot means mounted on the collar generally to one side of the longitudinal rotation axis clasped by the clasp portions to permit the relative movement of the clasp portions toward and away from each other; and respective grip portions each rigidly extending from a respective one of the clasp portions generally on the opposite side of the clasp portion from the respective attachment portion, the grip portions being movable toward and away from each other for so moving the clasp portions.

3. The machine of claim 2 wherein the clasp portions have opposed padded arcuate-bottle-engaging surfaces.

4. The machine of claim 3 wherein the bottle-engaging surfaces of the clasp portions have downwardly and inwardly inclined support sections for underlying a drip ring of the bottle.

5. The machine of claim 1 wherein the vertically translating driver comprises opposed first and second radially outward facing surfaces, the first radially outward facing surface including the gear rack and the second radially outward facing surface including the helical rack.

6. The machine of claim 1 wherein a spring urges the blade radially inward against the bottle neck.

7. The machine of claim 1 wherein the blade is formed circumferentially on a metal wheel.

8. The machine of claim 1 wherein the blade is formed as the apex of a generally triangular metal plate.

9. The machine of claim 1 wherein the helical pinion rack comprises pins to meshingly engage the helical pinion gear.

10. A method for extracting a cork from a bottle, the method comprising:

providing, a cork extracting machine comprising, in combination:

a rotatable pinion gear having a fixed radius and a horizontal rotational axis rotatably coupled to a shaft and engaging a gear rack of a vertically translating driver;

a helical worm coupled through a freely rotating connection to the vertically translating driver wherein the worm freely rotates about a longitudinal rotation axis coaxially aligned with a location of a bottle neck from which the cork is to be extracted;

a crank rotating the pinion gear for translating the driver up and down relative to the collar along the rotation axis of the helical worm;

a non-rotating collar cam releasably coupled between the vertically translating driver and an annular collar assembly receiving and following the helical worm for imparting torque rotating the worm; and a helical pinion rack affixed to the gear rack drives a helical pinion gear to rotate about the longitudinal rotation axis in meshing engagement with helical rack on the vertically translating driver, the helical pinion gear having at least one blade to contact the bottle neck scoring a foil capsule thereon as the helical pinion gear rotates;

translating the vertically translating driver along a rotational axis of the helical worm;

driving the helical worm into receiving engagement with the non-rotating collar cam; and driving the helical gear to rotate about the rotational axis, the helical gear having at least one blade to contact a neck of the bottle; and scoring the foil with the blade.

11. The method of claim 10 further comprising:

clasping the neck of the bottle by moving respective opposable clasp portions toward each other, thereby to position the bottle with respect to the collar in longitudinal alignment with a screw passage, and away from each other, to release the bottle, the clasp portions having pivot to permit the relative movement of the clasp portions toward and away from each other; and the clasp portions supporting respective grip portions each rigidly extending from a respective one of the clasp portions generally on the opposite side of the clasp portion from a respective attachment portion, the grip portions being movable toward and away from each other for so moving the clasp portions.

12. The method of claim 11 wherein the clasp portions have opposed padded arcuate-bottle-engaging surfaces.

13. The method of claim 12 wherein the bottle-engaging surfaces of the clasp portions have downwardly and inwardly inclined support sections for underlying a drip ring of the bottle.

14. The method of claim 10 wherein the vertically translating driver comprises opposed first and second radially outward facing surfaces, the first radially outward facing surface including the gear rack and the second radially outward facing surface including the helical rack.

15. The method of claim 10 wherein a spring urges the blade radially inward against the bottle neck.

16. The machine of claim 10 wherein the blade is formed circumferentially on a metal wheel.

17. The method of claim 10 wherein the blade is formed as the apex of a generally triangular metal plate.

18. The method of claim 10 wherein the helical rack comprises pins to meshingly engage the helical pinion gear.

* * * * *